US006539683B2

(12) United States Patent
Pilcher

(10) Patent No.: US 6,539,683 B2
(45) Date of Patent: Apr. 1, 2003

(54) DIRECTIONAL DRAINAGE ROOF SHINGLE

(76) Inventor: Joseph Mitchell Pilcher, 1616 Park Pl., Wichita, KS (US) 67203-2644

( * ) Notice: Subject to any disclaimer, the term of this patent is extended or adjusted under 35 U.S.C. 154(b) by 0 days.

(21) Appl. No.: 09/791,449

(22) Filed: Feb. 22, 2001

(65) Prior Publication Data

US 2001/0054267 A1 Dec. 27, 2001

Related U.S. Application Data

(60) Provisional application No. 60/184,309, filed on Feb. 22, 2000.

(51) Int. Cl.[7] ..... E04D 1/00

(52) U.S. Cl. ..... 52/518; 52/518; 52/535; 52/533; 52/519; 52/311.1; 52/314; 52/316; D25/139; D25/140; D25/141

(58) Field of Search ..... 52/518, 535, 533, 52/519, 311.1, 314, 316; D25/139, 140, 141

(56) References Cited

U.S. PATENT DOCUMENTS 2,284,705 A * 6/1942 Wickersham
3,691,343 A * 9/1972 Norman ..... 52/13
4,449,333 A * 5/1984 Strattom ..... 52/13

* cited by examiner

*Primary Examiner*—Carl D. Friedman
*Assistant Examiner*—Nahid Amiri
(74) *Attorney, Agent, or Firm*—Robert Blinn

(57) ABSTRACT

The roof shingle system of the present invention includes rows of shingle elements having parallel, slanting lower edges that are aligned to divert the flow of water away from areas where high flow volumes are not desired toward areas where high flow volumes will not cause harm. Because water flowing down a surface will tend to adhere to that surface, the water flowing down the surface of the shingle system of the present invention will tend to follow the slanting lower edges of the shingle elements in the direction of the slanted edges so as to provide a way to control the flow of water on the surface of a roof.

7 Claims, 4 Drawing Sheets

DIRECTIONAL DRAINAGE ROOF SHINGLE

CROSS REFERENCES TO RELATED APPLICATIONS

This application claims the benefit of U.S. Provisional Patent Application No. 60/184,309 filed Feb. 22, 2000.

FIELD OF THE INVENTION

This invention relates to roof coverings and in particular to a roof system that diverts the flow of water in a pattern of flow that avoids roof areas that are susceptible to leakage or water damage.

BACKGROUND OF THE INVENTION

Leaking roofs are a common problem for homeowners. Roof damage is often caused by leakage around openings such as skylights or leakage in high flow areas such as valleys between gables. Repairing such damage is often difficult, dangerous and expensive. Prior attempts to alleviate the effects of uncontrolled flow from roofs have met with limited success.

Common prior art roof systems develop problems because their drainage is totally uncontrolled. The flow of rain water from a roof having only a single gable and no penetrations such a skylight is very simple. Rain water flowing from such a simple roof takes a direct path down to the eaves and gutters of the roof. The flow of water from a roof having intersecting gables and openings such as sky lights is much more complex. The flow of water accumulates at gable intersections and around openings. A casual observation of the effects of the flow of water in nature quickly provides one with an impression of the erosive effects of uncontrolled water flow. Uncontrolled water flow upon roof structures has similar erosive effects. Rain water flowing off of a complex roof builds up in valleys between gables and runs in an uncontrolled fashion near parapet walls and chimneys and all along the edges of eaves. Provisions such as flashing for resisting the flow of water in high flow areas eventually fail under the pressure of repeated high volume energetic flow and expose materials that are susceptible to water damage. The transfer of water flowing from a complex roof to a gutter system is deficient because the gutter system must be adapted to accept uneven and uncontrolled flow. Prior roofing systems have not been designed to provide the optimal transfer of water from a roof to a gutter system, but rather, gutter systems have had to be adapted to accommodate the flow of water as dictated by the roof structure.

Even though a primary function of a roof is to protect a structure from the intrusion of water, the effective transfer of water from a prior art roof is not among the requirements that drives the design of a prior art roof. The pattern of drainage from a prior art roof is not optimized by design, but results from the architectural shape of the roof. The architectural shape of the roof is driven by esthetics and the internal geometry of the structure. Very little consideration is given to water flow when a prior art roof is designed. With a prior art roof, water simply follows an obvious downward path. A prior art roof will often have an accumulation of debris accumulation in the valleys between gables as well as debris in the gutter. This causes a moisture retention problem in the valleys and at the edges of eaves. Prior art roofing systems also require the periodic maintenance of flashing, parapet walls and chimneys where high volume energetic water flow often occurs. Consequently, prior art roofs fail in their main purpose of preventing the intrusion of the elements into a structure because they are not designed to manage the flow of rain water.

Prior art roof systems are also vulnerable to leaks during extreme weather. Snow and debris accumulate in the same areas that water tends to accumulate. Even if a roof is in good condition, problems often arise at the extremities of a roof system, especially in open valleys, parapet walls and the edges of eaves adjacent to clogged gutter systems.

One solution to the these problems would be to design roofs that have complex fluid dynamic shapes that are adapted to optimize the flow and transfer of rain water. No doubt this could make for a fascinating project for an architect and it is even possible that such a design project could produce fascinating and compelling shapes. However, it is unlikely that a practical solution gaining widespread acceptance in middle class residential neighborhoods would result from a theoretical project directed at creating fluid dynamic roof designs.

What is needed is a roofing shingle product that can be arranged in an array of shingles that will direct water away from vulnerable areas of a roof such as valleys between gables or penetrations and then also direct it to predetermined drainage areas where water flow will not cause damage. An array of such shingles would direct water in a predetermined pattern rather than being limited to having water to merely follow the slope of the roof. Such a roof shingle, for use in an array of shingles could be easy to manufacture and install.

SUMMARY OF THE INVENTION

The shingle system of present invention meets this need for improved drainage by providing a means to direct and control the flow of water as it flows down from a roof surface. In its simplest form, the roof system of the present invention includes rows of shingle elements having parallel, slanting lower edges that are aligned to divert the flow of water away from areas where high flow volumes are not desired toward areas where higher flow volumes will not cause harm. Because water flowing down a surface will tend to adhere to that surface, the water flowing down the surface of the shingle system of the present invention will tend to follow the slanting lower edges of the shingle elements in the direction of slant thereby providing a means for directing the flow of water on a roof.

A roof structure surface could be envisioned as being defined by set of contour lines that have constant elevation and a set of grade lines that are normal or perpendicular to the contour lines. As rain water flows down from a roof structure, it will have a direction of flow that is parallel to the grade lines and perpendicular to the contour lines of the roof. Stated more simply, on a roof surface, water will flow down hill.

However, the purpose of the present invention is to exploit a fluid flow phenomenon known as the "Coanda Effect". Water flowing on a surface tends to adhere to that surface, and when flowing water encounters an edge, it resists flowing off of that edge. Accordingly, if water flowing down a surface encounters an edge that is oriented at an angle in relation to the contour line, the direction of flow will be altered to following the direction of the edge as the water follows the edge. So then, while standard roof shingles have bottom edges that are parallel to roof contour lines and normal to roof grade lines, a pattern of shingles of the present invention will have lower edges that are all aligned at an angle in relation to the contour line of the roof. Flowing rain water that encounters the angled lower edges of the shingles changes direction and follows those slanted lower edges.

In its preferred embodiment, the shingle system of the present invention includes shingles that each have a base portion that includes an upper head lap section and a lower butt lap section. The head lap section of each shingle is usually covered from above by an overlapping butt lap section of an adjacent shingle. The butt lap section of the shingle includes two layers of overlapping shingle elements having slanted lower edges. The slanting lower edges are substantially parallel to each other and slant at an angle relative to the contour lines of the roof. These slanted lower edges are also parallel with each other. Where the slanted lower edges terminate, the water continues on its angular path to follow the next slanted lower edge of the next shingle. By using shingles of the present invention, rain water on a roof can be directed at an angle relative to the grade line across the surface of the roof. Even limited applications of shingles of the present invention on only a portion of a roof can substantially direct water away from vulnerable areas. The invention shingle could be made of the same materials as other roof coverings such as aluminum, asphalt, wood, copper or composites such as cement composites or an other suitable roofin material.

BRIEF DESCRIPTION OF THE DRAWINGS

The invention and its many attendant objects and advantages will become better understood upon reading the following description of the preferred embodiment in conjunction with the following drawings, wherein.

DETAILED DESCRIPTION OF THE INVENTION

Figure 1:
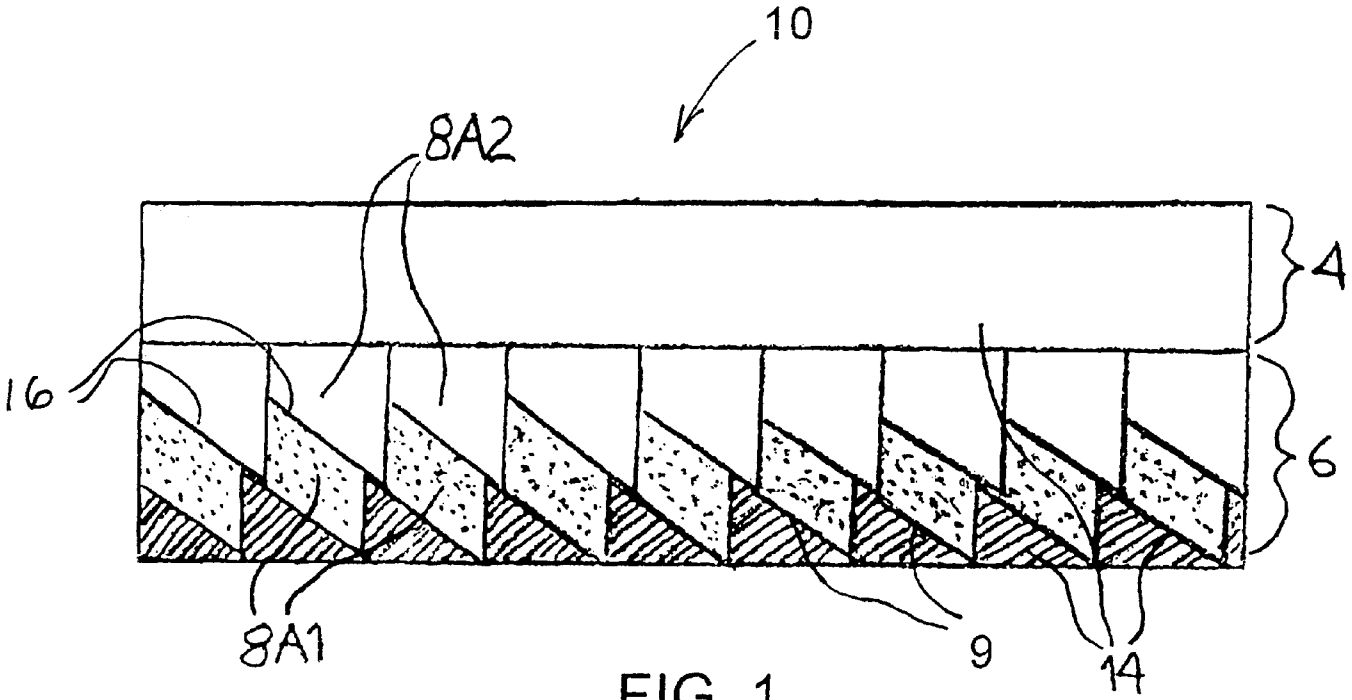
FIG. 1 is a plan view of the invention roof shingle.
Figure 3:
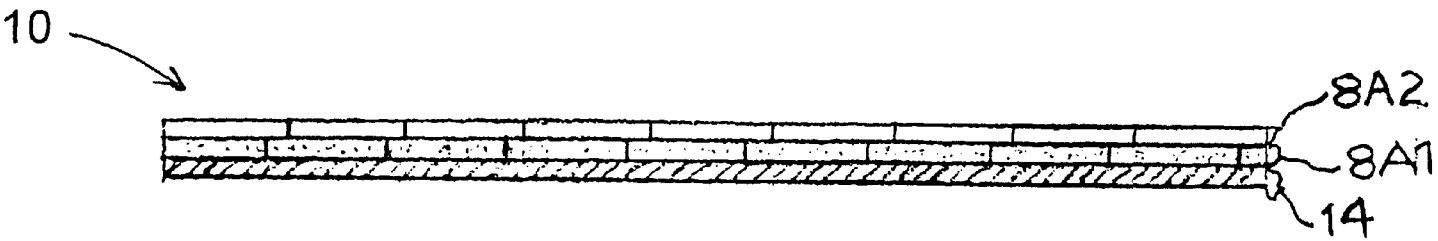
FIG. 3 is a front edge view of the invention roof shingle.
Figure 2:
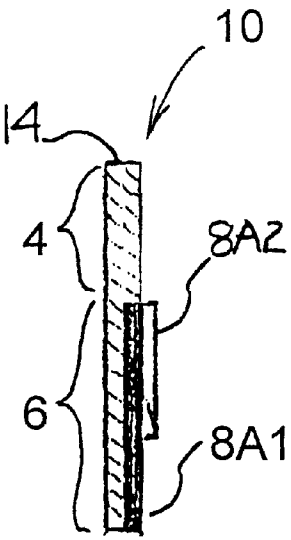
FIG. 2 is a side view of the invention roof shingle.

FIG. 1 shows an invention roof shingle 10. As can be better seen in left side view of FIG. 2 and lower edge end view of FIG. 3, roof shingle 10 generally includes a base shingle 14 that forms a head lap section 4 at its upper end and forms the base for a butt lap section 6 at its lower end. Butt lap section 6 further includes a first shingle 8A1 layered on top of base shingle 14 and a second shingle 8A2 layered on top of first shingle 8A1. As can be seen in FIG. 1, first shingle 8A1 includes a saw tooth pattern of slanted lower edges 9. In a similar fashion, second shingle 8A2 includes a saw tooth pattern of slanted lower edges 16 that are aligned and parallel to edges 9.

Figure 4:
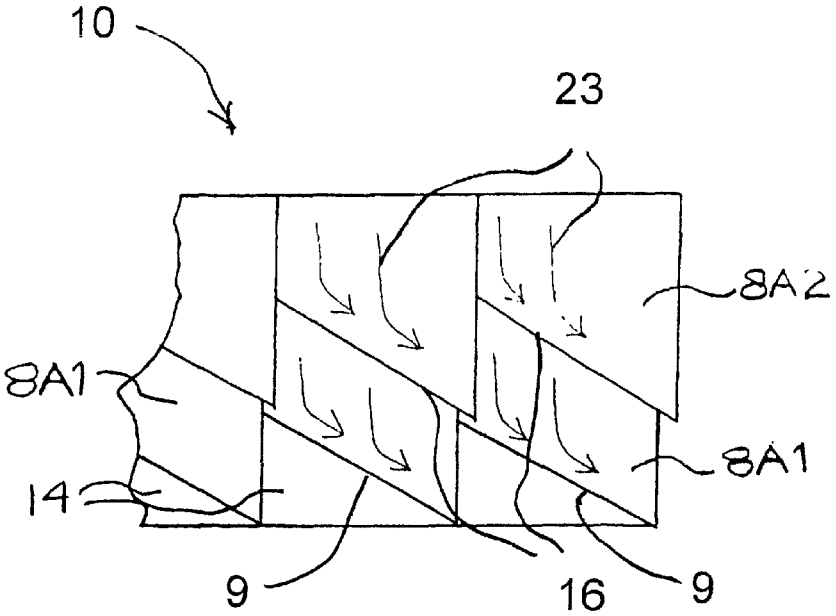
FIG. 4 is a plan view of invention roof shingle.

The flow of water 23 across invention shingle 10 is illustrated in FIG. 4. As can be seen in FIG. 4, water flow 23 moving down second shingle 8A2 adheres to the surface of second shingle 8A2 and encounters slanted lower edges 16. While adhering to the surface of second shingle 8A2, most of water flow 23 diverts to move in a direction substantially parallel to slanted lower edges 16. In a similar fashion, additional streams of water introduced by falling rain drops along with some of original water flow 23 moves across shingle 8A1 and encounter slanted edges 9 and are also mostly diverted along those edges. In this way a flow vector is established that is angled with respect to the slope of the roof. FIG. 4 also shows that slanted lower edge 16 will be slightly offset from the next adjacent slanted lower edge 9 of shingle 8A1. This slight offset facilitates the transfer of flowing water as the stream of flowing water transitions from following slanted lower edge 16 to following slanted lower edge 9.

Figure 5:
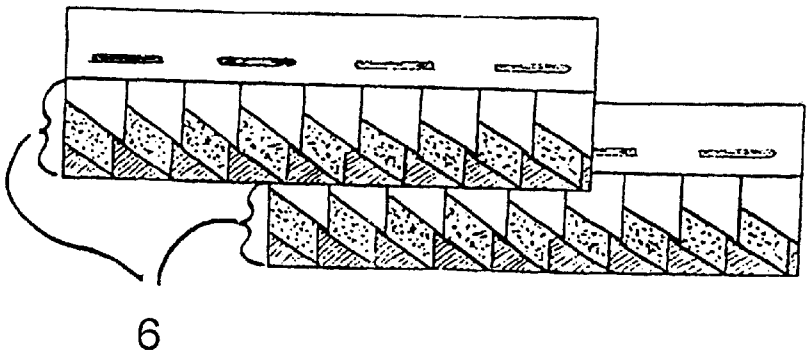
FIG. 5 is a plan view of invention shingle showing direction of water flow.

FIG. 5 provides a plan view which illustrates how invention shingle 10 may be positioned in relation to other invention shingles. When many shingles such as shingle 10 are attached to the surface of a roof using fastening systems well known in the art, water flow is redirected as described above so that water flow over the entire surface of a roof my be diverted away from vulnerable areas.

Figure 6:
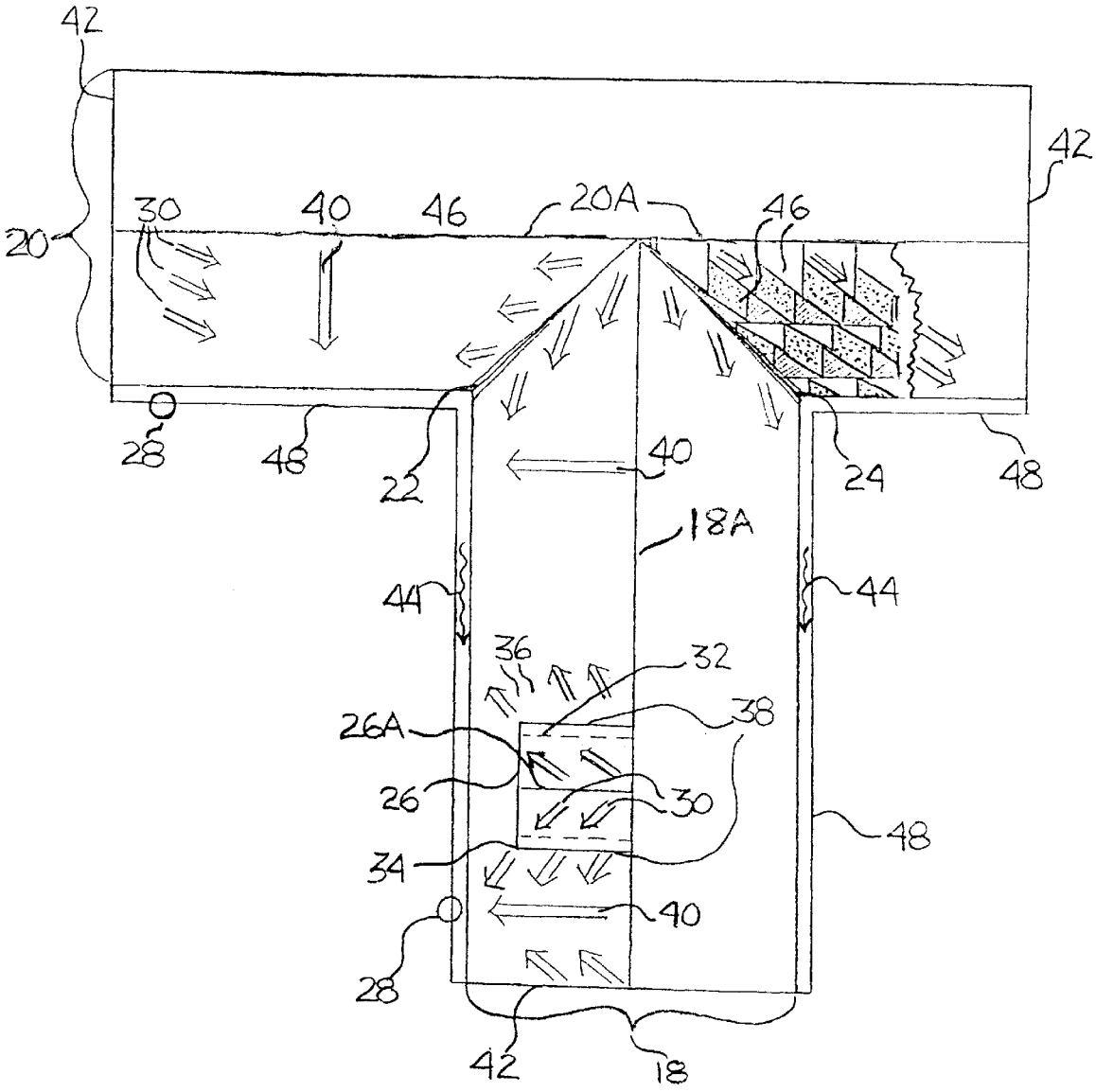
FIG. 6 is a top view of a roof with invention shingles showing the direction of water flow.

FIG. 6 shows and entire roof system in plan view. The application of rain water on a roof surface such as the roof illustrated in FIG. 6 is very uniform and very dispersed. Therefore, the flow of water on a roof structure is initially not concentrated in high volume energetic flows. Rain water striking the surface of the roof shown in FIG. 6 is dispersed very evenly and randomly across the surface of the roof. After striking the roof, the water forms a very large number of very small slow moving streams of trickling water. Because of the highly dispersed and unconcentrated nature of this pattern of flow, it is relatively easy to change the direction of the flow of water that is flowing or rather trickling down the surface of a roof.

The roof system shown in FIG. 6 includes intersecting gables 18 and 20, gable ridges 18A and 20A, valleys 22 and 24, dormer roof 26, down spouts 28, flow of water 30 and example water flow concentration zones 40 which are represented by directional arrows. FIG. 6 illustrates the directing of the flow of water that can be accomplished by using shingles of the present invention. For example, flow 30 is directed away from valleys 22 and 24 by patterns of invention shingles such as shingle pattern 46. Water therefore is diverted away from vulnerable valleys such as valleys 22 and 24 and valley metal 22. Flow 30 is also directed away from gable edges 42 by invention shingles such as is shown in shingle pattern 46 toward water flow concentration areas 40 and on to down spouts 28. In a similar way, water flow is directed away from dormer 26. A lesser concentration of water falls off of dormer gable eaves 38 and onto roof 36 and is channeled away from parapet walls 32 and toward down spout 28. Heavy concentrations of water 40 are no longer flowing in the low areas of the roof structure, nor are they flowing in valleys. All roof water flow terminates at gutter 48 and down spouts 28. Shingles 46 could be arranged to form a closed valley 24 over the top of valley metal 22. High concentrations of roof water 40 flow into gutter 46 at the high point of the gutter system, maintaining a high volume of water at beginning of gutter where with prior art shingles little water would be flowing. Arrows 44 illustrate the direction of water flow in the gutter system. High concentrations of water 40 are established by the by placing opposite right hand and left hand patterns of shingles.

Figure 7:
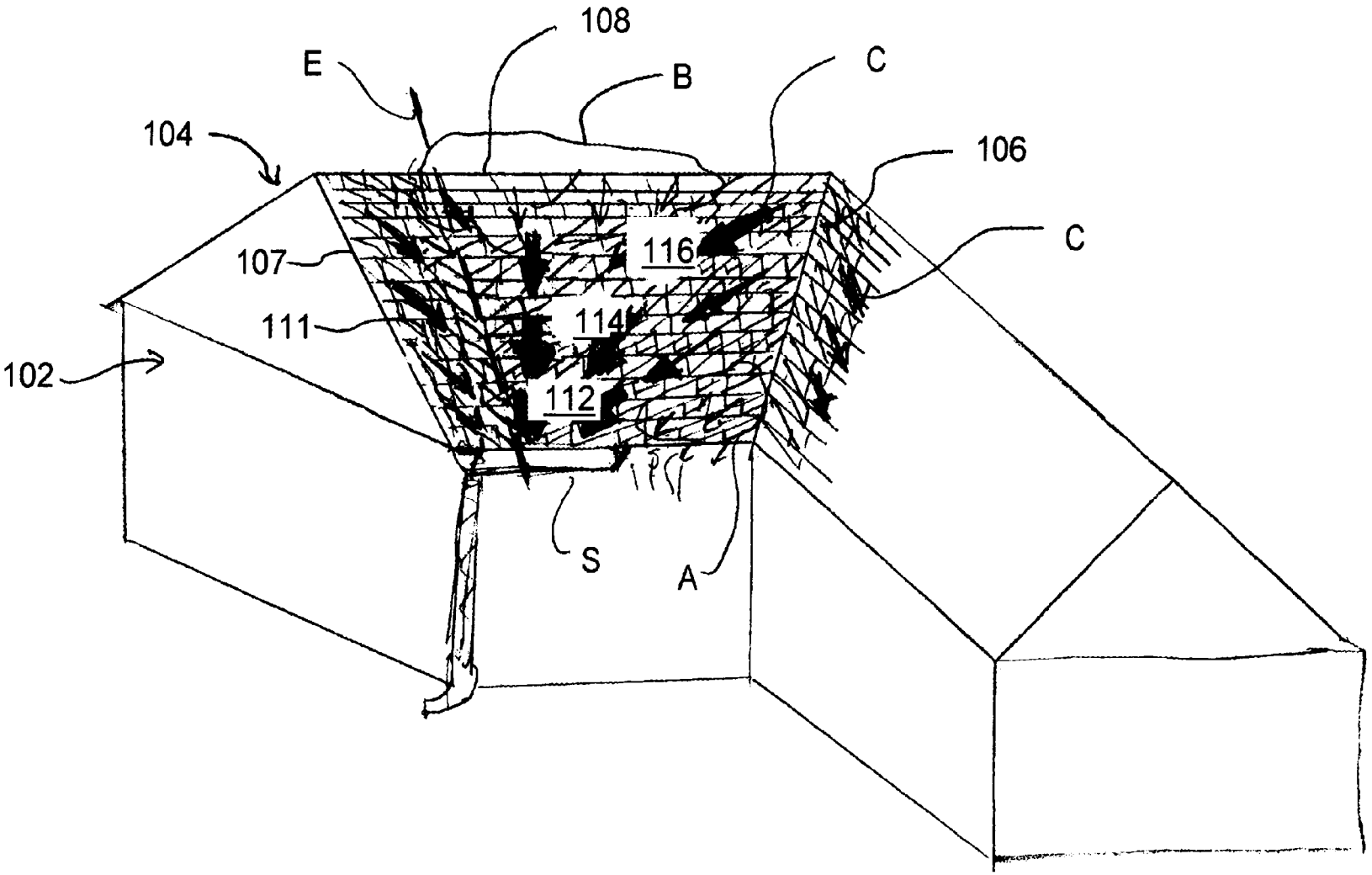
FIG. 7 is a perspective view of a roof with invention shingles showing the direction of water flow.

FIG. 7 provides a perspective view of invention directional shingles 111, 112, 114 and 116 installed on a roof structure 104 of a house 102. Roof structure 104 includes a valley 106, an edge 107 and a peak 108. Three sets of directional shingles are used on roof structure 104. A first set of shingles 111 is located adjacent to edge 107 and includes shingles having steeply angled lower edges of at least 45 degrees. First set of shingles 111 are arranged with their lower edges slanting away from roof edge 107 so as to divert water away from roof edge 107. A second set of shingles 112 has a relatively shallow lower edge angle of approximately 30 degrees. Located higher on roof structure 104 is a third set 114 whose shingles have a steeper lower edge angle of approximately 37 degrees. Near the top of roof structure 104 is a fourth set of shingles 116 comprised of shingles having a steep lower edge angle of approximately 45 degrees.

Set of shingles 112, set of shingles 114 and set of shingles 116 are arranged so that their lower edges are angled in a progressively more shallow manner near the lower portions of the roof structure surface. With this arrangement as flowing water first follows the edges of set of shingles 116, it assumes a direction of flow that is at a first angle of approximately at 45 degrees with respect to the grade line. As flowing water leaves set of shingles 116 and enters set of shingles 114, it takes on a direction of flow that is at a second, larger angle of approximately 53 degrees with respect to the grade line. Finally, as water leaves set of shingles 114 and enters set of shingles 112, it changes direction from a path that is at a third, even larger angle of approximately 53 degrees with respect to the grade line of the roof to a path that is at an angle of approximately 60 degrees with respect to the grade line of the roof. By diverting the flow of water on the roof by angles that are progressively greater in relation to the grade line of the roof, it is possible to divert water from a large portion of a roof surface to a relatively small portion of the lower edge of the roof. In this way, roof shingles of the present invention having differently angled lower edges can be arranged to transfer water from a large area to a relatively small collecting zone.

FIG. 7 also illustrates how the pattern of lower edges set at angles can create an illusion of a roof valley at a virtual valley line E. This illusion of a valley where none is actually present is an example of how shingles of the present invention can be used to create interesting visual effects on a roof surface to give the appearance of a contour where no contour is present. It should also be apparent to those skilled in the art that shingles having slanted lower edges can be made so that the slanted lower edges are barely visible or are highly visible. Where slanted lower edges are barely visible, the visual effect of a contour where none is present will not occur. Where slanted lower edges are highly visible, the visual effect of a contour will be very evident. The term virtual valley is somewhat misleading since water will actually tend to flow toward virtual valley E on roof structure 104 as if it were a true valley. As water flow direction arrows C indicate, rain water flowing down roof structure 104 will tend to flow toward virtual valley line E as if it were a true valley such as valley 106. As shown in FIG. 7, water will tend to flow to high capacity gutter S where almost all of the water from that portion of the roof can be collected. Rain water falling upon zone A shown in FIG. 7 would not be captured by gutter S. However, that amount of rain water would include only a small portion of the rain falling upon roof structure 104. Substantially all of the rain water falling upon roof surface 104 shown in FIG. 7 between valley 106 and edge 107 would flow into gutter S. Moreover, because of the arrangement of invention shingles on roof structure 104, water will tend to flow away from valley 106 and toward virtual valley E. Virtual valley E is a much more appropriate location on roof structure 104 to have a concentrated flow of water. A concentrated flow of water at valley 106 would tend to damage roof structure 104. However, no such concentrated flow of water will occur in valley 106 of roof structure 104. In fact, almost no water will flow in valley 106. Because of the placement of oppositely angled directional shingles on either side of valley 106, water will flow away from valley 106 as if it were a raised area such as peak 108. This demonstrates how various types of directional shingles can be used to manage and control the flow of water across the surface of a roof structure.

As can be seen from the forgoing description, patterns of invention shingles can be employed to control the flow pattern across an entire roof or in local areas of a roof to solve local flow problems. All of this flow management capability is based on the tendency of water to adhere to a surface and the use of that property to redirect water flow from an undesirable location on a roof to a more preferred location on a roof. By using patterns of shingles of the present invention, the pattern of flow of water on a pitched shingled roof can be established as a matter of design choice, thereby improving the performance roof structures as they perform their most basic function and also thereby significantly extending the useful life of many roof structures.

Obviously, in view of the numerous embodiments described above, numerous modifications and variations of the preferred embodiments disclosed herein are possible and will occur to those skilled in the art in view of this description. For example, many functions and advantages are described for the preferred embodiments, but in some uses of the invention, not all of these functions and advantages would be needed. Therefore, I contemplate the use of the invention using fewer than the complete set of noted functions and advantages. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly to be understood that these modifications and variations, and the equivalents thereof, are to be considered within the spirit and scope of the invention as defined by the following claims, wherein,

I claim:

1. A system of shingles for covering a roof surface comprising;

overlapping shingles disposed on the surface of a roof, the surface of the roof including a valley defined by intersecting roof surfaces, the intersecting roof surfaces having parallel contour lines of constant elevation and grade lines that are perpendicular to the contour lines, said overlapping shingles in sets of shingles disposed on the roof surfaces on either side of the valley, the shingles having slanted lower edges and said shingles arranged on the roof surface such that at least some of the lower edges of the shingles in each set of shingles slant away from the valley, whereby rain water flowing down the roof surfaces is diverted to flow away from the valley in directions that are at angles with respect to the grade lines of the intersecting roof surfaces.

2. A system of shingles for covering a roof surface comprising;

overlapping shingles disposed on the surface of a roof, the surface of the roof including a preselected area, the roof surface having parallel contour lines of constant elevation and grade lines that are perpendicular to the contour lines, said overlapping shingles including sets of shingles disposed on the roof surface on either side of the preselected area, the shingles having slanted lower edges and said shingles arranged on the roof surface such that at least some of the lower edges of the shingles in each set of shingles slant toward the preselected area whereby rain water flowing down the roof surface is diverted to flow toward the preselected area in directions that are at angles with respect to the grade lines of the roof surface.

3. The system of shingles for covering a roof surface of claim 2 wherein:

the shingles are arranged on the roof surface such that the lower edges of the shingles slant away from the preselected area whereby rain water flowing down the roof surface is diverted to flow away from the preselected area in directions that are at angles with respect to the grade lines of the roof surface.

4. The system of shingles for covering a roof surface of claim 2 wherein:

at least two sets of shingles having slanted lower edges are arranged on the roof so that the slanted lower edges of the sets of shingles slant upwardly in relation to the contour of the roof toward a preselected zone to create the illusion that the preselected zone is a ridge.

5. The system of shingles for covering a roof surface of claim 2 wherein:

at least two sets of shingles having slanted lower edges that are arranged on the roof so that the slanted lower edges of the sets of shingles slant downwardly in relation to the contour of the roof toward a preselected zone to create the illusion that the preselected zone is a valley.

6. The system of shingles for covering a roof surface of claim 2 wherein:

the sets of shingles include at least two groups of shingles wherein a first group having lower edges that are oriented at a first angle relative to the contour line of the roof is placed on a roof surface and wherein a second group of shingles is placed on the roof surface below the first set of shingles, the second group of shingles having lower edges that are oriented at a second angle relative to the contour line of the roof that is smaller than the first angle and yet oriented in the same general direction so that as water flows from the first set of shingles onto the second set of shingles, the water flows in a direction that is at a smaller angle in relation to the contour line of the roof than when it was flowing on the first set of shingles.

7. The system of shingles for covering a roof surface of claim 2 wherein:

the sets of shingles each include at least two groups of shingles wherein a first group having lower edges that are oriented at a first angle relative to the contour line of the roof is placed on a roof surface and wherein a second group of shingles is placed on the roof surface below the first set of shingles, the second group of shingles having lower edges that are oriented at a second angle relative to the contour line of the roof that is smaller than the first angle and yet oriented in the same general direction so that as water flows from the first group of shingles onto the second group of shingles, the water flows in a direction that is at a smaller angle in relation to the contour line of the roof than when it was flowing on the first set of shingles, and wherein the groups of shingles are arranged to progressively divert water across the surface of the roof at progressively shallower angles in relation to the contour of the roof toward a preselected zone at the lower edge of the roof so that substantially most of the rain water striking the roof may be collected from the roof with a collection means that is arranged to collect water from only a portion of the lower edge of the roof.

* * * * *